US008610368B2

(12) United States Patent
Lin et al.

(10) Patent No.: US 8,610,368 B2
(45) Date of Patent: Dec. 17, 2013

(54) SERIAL-TYPE LIGHT-EMITTING DIODE (LED) DEVICE

(75) Inventors: Li-Wei Lin, Zhonghe (TW); Chen-Chiang Lee, Zhonghe (TW); Chi-Hsin Lee, Zhonghe (TW)

(73) Assignee: Top Victory Investments Ltd., Harbour (HK)

( * ) Notice: Subject to any disclaimer, the term of this patent is extended or adjusted under 35 U.S.C. 154(b) by 373 days.

(21) Appl. No.: 12/974,074

(22) Filed: Dec. 21, 2010

(65) Prior Publication Data

US 2011/0148314 A1 Jun. 23, 2011

(30) Foreign Application Priority Data

Dec. 21, 2009 (TW) ..... 98143826 A
Apr. 8, 2010 (TW) ..... 99206202 U

(51) Int. Cl.
*G05F 1/00* (2006.01)

(52) U.S. Cl.
USPC ..... 315/291; 315/247; 315/307; 315/185 S; 315/312

(58) Field of Classification Search
USPC ..... 315/247, 246, 185 S, 224, 307–326, 315/291, 274–289
See application file for complete search history.

(56) References Cited

U.S. PATENT DOCUMENTS 7,196,483 B2 * 3/2007 Wey et al. ..... 315/312
8,531,125 B2 * 9/2013 Kim et al. ..... 315/279

* cited by examiner

*Primary Examiner* — Tuyet Thi Vo
(74) *Attorney, Agent, or Firm* — Alan Kamrath; Kamrath IP Lawfirm, P.A.

(57) ABSTRACT

A serial-type LED device includes p light source units and a dimming circuit. Each light source unit includes first and second terminals, m light strings and m current balance units. Each light string includes LEDs coupled in series to have a first terminal coupled to the first terminal of a corresponding light source unit and a second terminal coupled to the second terminal of the corresponding light source unit through a corresponding current balance unit. The first terminal of the first light source unit is coupled to a second DC voltage, and the second terminal of the i-th light source unit is coupled to the first terminal of the (i+1)-th light source unit, where m and p are integers greater than or equal to 2, and i is any integer from 1 to (p−1). The dimming circuit coupled to the second terminal of the p-th light source unit controls the second DC voltage according to a current outputted from the p-th light source unit.

6 Claims, 7 Drawing Sheets

SERIAL-TYPE LIGHT-EMITTING DIODE (LED) DEVICE

BACKGROUND OF THE INVENTION

1. Field of the Invention

The present invention relates to a light-emitting diode (LED) device. More particularly, the present invention relates to a serial-type LED device.

2. Description of the Related Art

An LED light source employs a plurality of LEDs to provide sufficient brightness. The LEDs can be coupled in series to drive so that each LED provides substantially the same brightness due to the same current flowing through each LED. However, the serial LEDs will not work if one of the LEDs does not work. In addition, the driving voltage applied to the serial LEDs increases as the number of the LEDs coupled in series increases, so that the driving voltage may be too high, resulting result in higher cost and increasing complexity of the circuit design.

To avoid the disadvantage of the serial LEDs, the LEDs can be divided into several groups. The LEDs of each group are coupled in series as a light string, and all light strings are coupled in parallel, so that the LEDs of each light string provide substantially the same brightness and so that each light string provides the same brightness by employing a current balance technology. In addition, if one of the light strings does not work, the others of the light strings can still work. However, as the number of the light strings increases, the circuit design of the current balance circuit becomes complex.

SUMMARY OF THE INVENTION

Accordingly, a serial-type LED device is provided for employing a simple current balance circuit while avoiding that all light strings will not work if one of the light strings does not work.

According to an aspect of the invention, a serial-type LED device includes a direct-current to direct-current (DC to DC) converter, p light source units and a dimming circuit. The DC to DC converter receives a first DC voltage and converts the first DC voltage to a second DC voltage according to a feedback signal. Each light source unit includes a first terminal, a second terminal, m light strings and m current balance units, and each light string includes a plurality of LEDs coupled in series to have a first terminal coupled to the first terminal of a corresponding light source unit and a second terminal coupled to the second terminal of the corresponding light source unit through a corresponding current balance unit. The p light source units are first to p-th light source units, the first terminal of the first light source unit is coupled to the DC to DC converter to receive the second DC voltage, and the second terminal of the i-th light source unit is coupled to the first terminal of the (i+1)-th light source unit, where m and p are integers greater than or equal to 2, and i is any integer from 1 to (p−1). The dimming circuit coupled to the second terminal of the p-th light source unit and the DC to DC converter outputs the feedback signal according to a dimming signal and a current outputted from the p-th light source unit.

In another embodiment, a dimming circuit coupled to the second terminal of the p-th light source unit outputs a control signal to control the current balance units of the p-th light source unit not to work when receiving an off signal, and outputs the control signal to control the current balance units of the p-th light source unit to alternatively work and not work according to a dimming signal when receiving an on signal.

BRIEF DESCRIPTION OF THE DRAWINGS

The foregoing and other features of the disclosure will be apparent and easily understood from a further reading of the specification, claims and by reference to the accompanying drawings in which:

DESCRIPTION OF THE PREFERRED EMBODIMENTS

Figure 1:
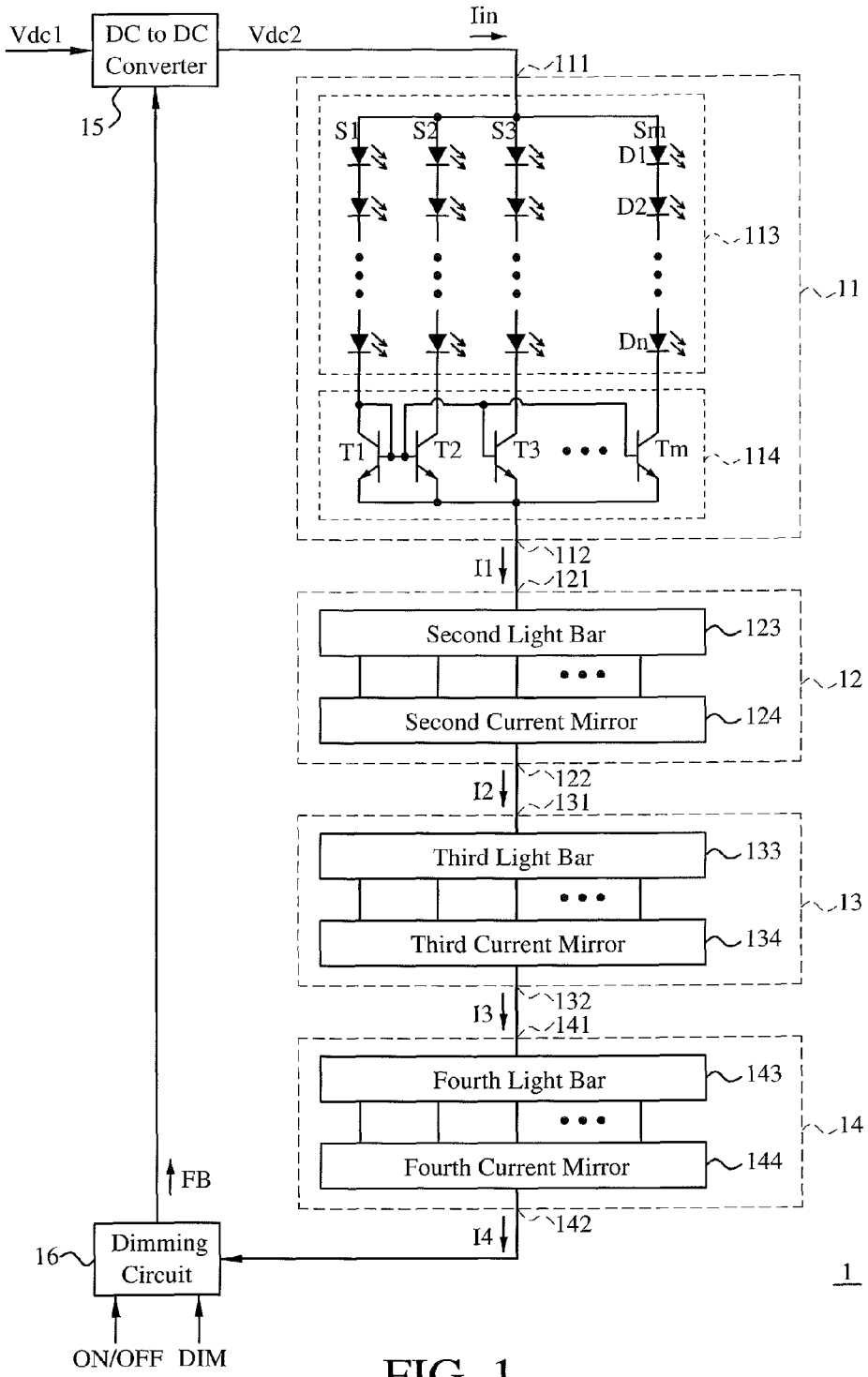
FIG. 1 is a schematic diagram illustrating an embodiment of a serial-type LED device according to the invention.

FIG. 1 is a schematic diagram illustrating an embodiment of a serial-type LED device according to the invention. Referring to FIG. 1, a serial-type LED device 1 includes 4 light source units 11-14, a DC to DC converter 15 and a dimming circuit 16. The DC to DC converter 15 receives a first DC voltage Vdc1 and converts the first DC voltage Vdc1 to a second DC voltage Vdc2 according to a feedback signal FB. The DC to DC converter 15 employs full-bridge, half-bridge, forward, flyback or other suitable topology. The first DC voltage Vdc1 is 5V, 12V, 24V or other typical voltage provided by a power supply is (not shown). The second DC voltage Vdc2 is sufficient to drive the light source units 11-14.

Each light source unit includes a first terminal, a second terminal, m light strings and m current balance units, where m is an integer greater than or equal to 2. For example, the light source unit 11 includes the first terminal 111, the second terminal 112, the light strings S1-Sm and the current balance units T1-Tm. Each light string includes a plurality of LEDs coupled in series to have a first terminal coupled to the first terminal of a corresponding light source unit and a second terminal coupled to the second terminal of the corresponding light source unit through a corresponding current balance unit. For example, in the light source unit 11, each light string, such as light string S1, includes the LEDs D1-Dn coupled in series to have the first and second terminals. The first terminal of the light string S1 is coupled to the first terminal 111 of a corresponding light source unit 11, and the second terminal of the light string S1 is coupled to the second terminal 112 of the corresponding light source unit 11 through a corresponding current balance unit T1. Therefore, the light strings S1-Sm are substantially coupled in parallel and controlled to achieve current balance through the current balance units T1-Tm.

The light source units 11-14 are the first light source unit 11, the second light source unit 12, the third light source unit 13 and the fourth light source unit 14. The first terminal 111 of the first light source unit 11 is coupled to the DC to DC converter 15 to receive the second DC voltage Vdc2, the second terminal 112 of the first light source unit 11 is coupled to the first terminal 121 of the second light source unit 12, the second terminal 122 of the second light source unit 12 is coupled to the first terminal 131 of the third light source unit 13, the second terminal 132 of the third light source unit 13 is coupled to the first terminal 141 of the fourth light source unit 14, and the second terminal 142 of the fourth light source unit 14 is coupled to the dimming circuit 16. Therefore, the light source units 11-14 are substantially coupled in series to employ a simple dimming circuit such as the dimming circuit 16. In addition, an input current Iin is equal to a current I1, I2, I3 or I4 outputted from the light source unit 11, 12, 13 or 14.

The dimming circuit 16 is coupled to the second terminal 142 of the fourth light source unit 14 and to the DC to DC converter 15. The dimming circuit 16 outputs the feedback signal FB according to the current I4 outputted from the fourth light source unit 14, and the feedback signal FB, such as a current proportional to the current I4, is used to control the DC to DC converter 15 to modulate the second DC voltage Vdc2. The dimming circuit 16 can control the second terminal 142 of the light source unit 14 to be open or coupled to ground according a dimming signal DIM having pulse-width modulation (PWM) waveform (alternately at a high level and at a low level). The current balance units T1-Tm are worked so that the light source units 11-14 are turned on to provide light while the second terminal 142 of the light source unit 14 is coupled to ground, and the current balance units T1'-Tm' are not worked so that the light source units 11-14 are turned off to provide no light while the second terminal 142 of the light source unit 14 is open, so that it achieves a PWM dimming. In other words, the current balance units T1'-Tm' are alternately worked and not worked according to the PWM dimming.

In one embodiment, the light strings S1-Sm of the q-th light source unit constitute a q-th light bar, where q is any integer from 1 to p. For example, the light strings S1-Sm of the first light source unit 11 constitute the first light bar 113, the light strings S1-Sm of the second light source unit 12 constitute the second light bar 123, the light strings S1-Sm of the third light source unit 13 constitute the third light bar 133, and the light strings S1-Sm of the fourth light source unit 14 constitute the fourth light bar 143. The first to p-th light bars are arranged to be a backlight of a display device. For example, the first and second light bars 113 and 123 are arranged on the upper side of the display panel of the display device, and the third and fourth light bars 133 and 143 are arranged on the lower side of the display panel of the display device.

In one embodiment, each current balance unit of the q-th light source unit includes a first transistor, such as, but not limited to, an NPN bipolar junction transistor (BJT) or N-channel field-effect transistor (FET), where q is any integer from 1 to p. Each first transistor comprises a first terminal coupled to the second terminal of a corresponding light string, a second terminal coupled to the second terminal of the q-th light source unit, and a control terminal. The control terminals of the first transistors are coupled to each other and the first terminal of one of the first transistors so that the first transistors of the q-th light source unit constitute a q-th current mirror. For example, the current balance units T1'-Tm' of the first light source unit 11 are matched NPN BJTs each including a first terminal (i.e. a collector terminal), a second terminal (i.e. an emitter terminal) and a control terminal (i.e. a base terminal). The first terminal of the first transistor T1 is coupled to the second terminal of a corresponding light string S1, the first terminal of the first transistor T2 is coupled to the second terminal of a corresponding light string S2, . . . , and the first terminal of the first transistor Tm is coupled to the second terminal of a corresponding light string Sm. The second terminals of the first transistors T1-Tm are coupled to the second terminal 112 of the first light source unit 11. The control terminals of the first transistors T1-Tm are coupled to each other and to the first terminal of one of the first transistors T1-Tm, such as the first terminal of the first transistor T1. Accordingly, the first transistors T1-Tm of the first light source unit 11 constitute the first current mirror 114. In addition, the first transistors T1-Tm of the second light source unit 12 constitute the second current mirror 124, the first transistors T1-Tm of the third light source unit 13 constitute the third current mirror 134, and the first transistors T1-Tm of the fourth light source unit 14 constitute the fourth current mirror 144. The current mirrors 114, 124, 134 and 144 cause the light bars 113, 123, 133 and 143 to achieve current balance, respectively.

Figure 2:
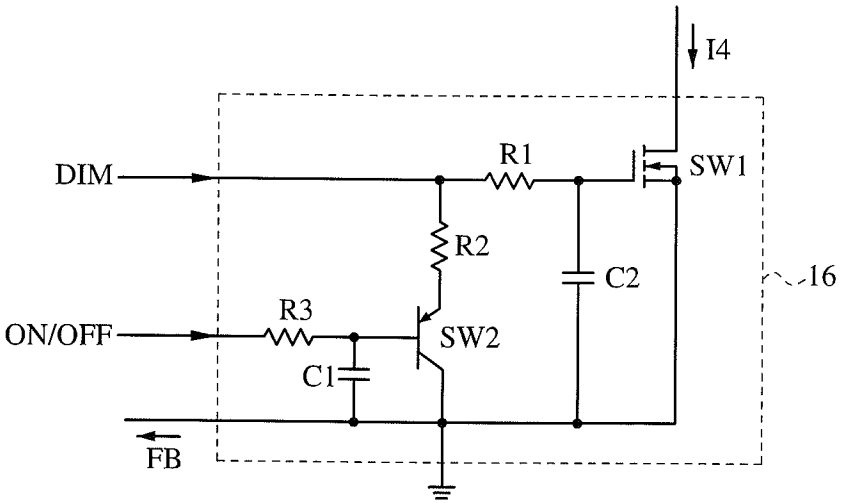
FIG. 2 is a schematic diagram illustrating an embodiment of the dimming circuit shown in FIG. 1.

FIG. 2 is a schematic diagram illustrating an embodiment of the dimming circuit 16 shown in FIG. 1. Referring to FIG. 2, the dimming circuit 16 includes a first switch SW1 and a second switch SW2 each including a first terminal, a second terminal and a control terminal. The first terminal of the first switch SW1 is coupled to the second terminal 142 of the fourth light source unit 14 to receive the current I4. The second terminal of the first switch SW1 is coupled to the DC to DC converter 15 to output the feedback signal FB according to the dimming signal DIM and the current I4. The control terminal of the first switch SW1 is coupled to receive the dimming signal DIM. The first switch SW1 is turned on or off according to the dimming signal DIM. The first terminal of the second switch SW2 is coupled to the control terminal of the first switch SW1. The second terminal of the second switch SW2 is coupled to a disable signal. In the embodiment, the disable signal is a low-level signal, such as a ground signal. The control terminal of the second switch SW2 is coupled to receive an on-off signal ON/OFF. The second switch SW2 is turned on or off according to the on-off signal ON/OFF.

When the second switch SW2 is turned on, the disable signal is coupled to the control terminal of the first switch SW1 through the second switch SW2 so that the first switch SW1 is turned off. When the second switch SW2 is turned off, the disable signal cannot be coupled to the control terminal of the first switch SW1, and the control terminal of the first switch SW1 will receive the dimming signal DIM so that the first switch SW1 is turned on or off according to the dimming signal DIM. In the embodiment, the first switch SW1 is implemented by an N-channel FET, and the second switch SW2 is implemented by a PNP BJT. The resistors R1-R3 are used to limit current flowing through the switches SW1 and SW2 implemented by transistors. The capacitors C1 and C2 are used to filter high-frequency noise.

Figure 3:
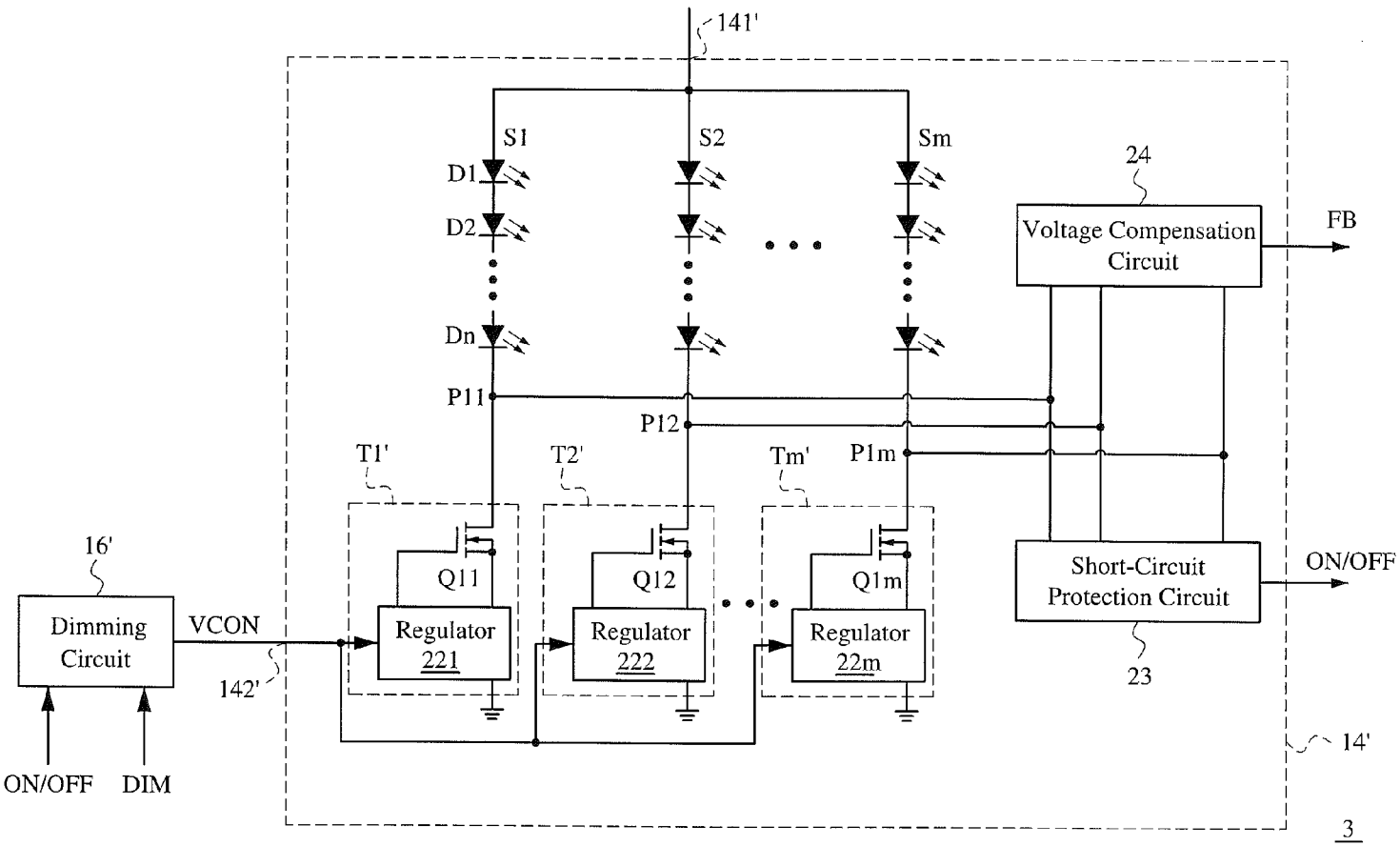
FIG. 3 is a schematic diagram illustrating another embodiment of a serial-type LED device according to the invention.

FIG. 3 is a schematic diagram illustrating another embodiment of a serial-type LED device according to the invention. Referring to FIG. 3, a serial-type LED device 3 includes a DC to DC converter (not shown), first to third light source units (not shown), a fourth light source unit 14' and a dimming circuit 16'. The DC to DC converter employs, but is not limited to, the DC to DC converter 15 shown in FIG. 1, and the first to third light source units employ, but are not limited to, the first to third light source units 11-13 shown in FIG. 1. The fourth light source unit 14' includes a first terminal 141' coupled to the second terminal of the third light source unit, a second terminal 142', m light strings S1-Sm, m current balance units T1'-Tm', a short-circuit protection circuit 23 and a voltage compensation circuit 24.

Figure 4A:
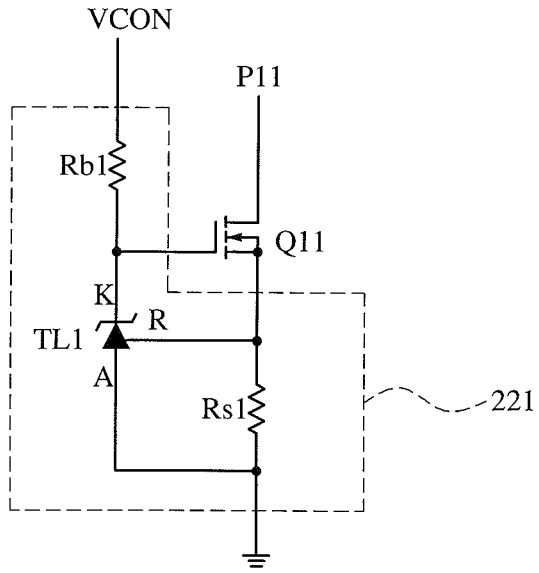
FIG. 4A is a schematic diagram illustrating an embodiment of the current balance unit shown in FIG. 3.

FIG. 4A is a schematic diagram illustrating an embodiment of the current balance unit shown in FIG. 3. Referring to FIGS. 3 and 4A, each current balance unit, such as current balance unit T1', includes a second transistor Q11 and a regulator 221. The regulator 221 includes a current-limiting resistor Rb1, a detecting resistor Rs1 and a shunt regulator TL1. The shunt regulator TL1, such as a commercial integrated circuit (IC) TL431 or TL432, includes a cathode terminal K, an anode terminal A and a reference terminal R. The current-limiting resistor Rb1 includes a first terminal coupled to the dimming circuit 16' to receive a control signal VCON, and a second terminal coupled to the control terminal of the second transistor Q11 and the cathode terminal K of the shunt regulator TL1. The detecting resistor Rs1 includes a first terminal coupled to the second terminal of the second transistor Q11 and the reference terminal R of the shunt regulator TL1, and a second terminal coupled to the anode terminal A of the shunt regulator TL1 and ground.

Because a current flowing through the light string S1 flows through the second transistor Q11 and the detecting resistor Rs1, the detecting resistor Rs1 is used to detect the current flowing through the light string S1. If the shunt regulator TL1 employs an IC TL431, the shunt regulator TL1 will compare a voltage at the reference terminal R and an internal reference voltage Vref of 2.5V. When the voltage at the reference terminal R is greater than the reference voltage Vref of 2.5V, the shunt regulator TL1 is conducted, and the cathode terminal K and the anode terminal A behave as short circuit. When the voltage at the reference terminal R is less than the reference voltage Vref of 2.5V, the shunt regulator TL1 is not conducted, and the cathode terminal K and the anode terminal A behave as open circuit. In the embodiment, the desired current is the reference voltage Vref divided by a resistance of the detecting resistor Rs1, and expressed as Vref/Rs1. Therefore, the desired current can be changed by employing different shunt regulators having different reference voltages.

When the control signal VCON is a low-level signal, the control terminal of the second transistor Q11 is coupled to the low-level signal and operated in a cut-off region, no current flows through the detecting resistor Rs1, the voltage across the detecting resistor Rs1 (i.e. the voltage at the reference terminal R) becomes zero, the shunt regulator TL1 is not conducted, so that the regulator 221 does not work to control the second transistor Q11 to regulate the current flowing through the light string S1. When the control signal VCON is a high-level signal, the regulator 221 works and the second transistor Q11 operates in a linear region, the regulator 221 detects the current flowing through a corresponding light string S1 and compares it with the desired current. When the current flowing through the corresponding light string S1 is greater than the desired current (i.e. the voltage across the detecting resistor Rs1 is greater than the reference voltage Vref), the shunt regulator TL1 is conducted, the control terminal of the second transistor Q11 is coupled to ground, and the operating point of the second transistor Q11 is controlled to move to the cut-off region to reduce the current flowing through the light string S1. When the current flowing through the corresponding light string S1 is less than the desired current (i.e. the voltage across the detecting resistor Rs1 is less than the reference voltage Vref), the shunt regulator TL1 is not conducted, the control terminal of the second transistor Q11 is coupled to a high-level control signal VCON, and the operating point of the second transistor Q11 is controlled to move from the cut-off region to increase the current flowing through the light string S1.

Figure 4B:
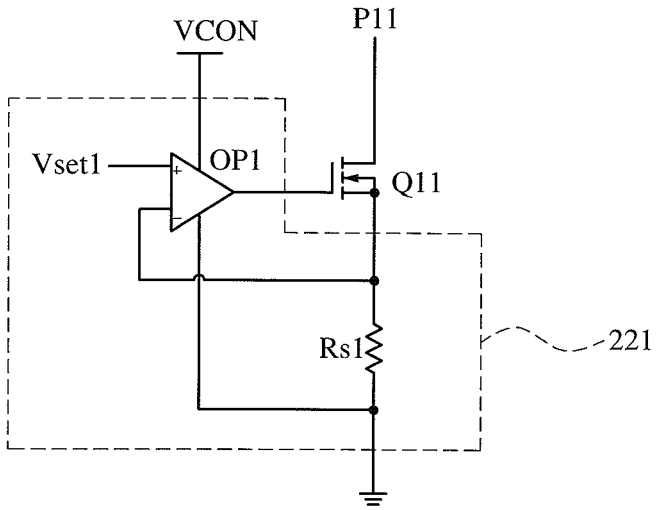
FIG. 4B is a schematic diagram illustrating another embodiment of the current balance unit shown in FIG. 3.

FIG. 4B is a schematic diagram illustrating another embodiment of the current balance unit shown in FIG. 3. Referring to FIGS. 3 and 4B, the current balance unit, such as current balance unit T1', includes a second transistor Q11 and a regulator 221. The regulator 221 includes an operational amplifier OP1 and a detecting resistor Rs1. The operational amplifier OP1 includes a non-inverting input terminal coupled to a setting voltage Vset1, an inverting input terminal coupled to the second terminal of the second transistor Q11, an output terminal coupled to the control terminal of the second transistor Q11, and a power terminal coupled to the dimming circuit 16' to receive the control signal VCON. The detecting resistor Rs1 includes a first terminal coupled to the second terminal of the second transistor Q11, and a second terminal coupled to ground. In the embodiment, the power terminal of the operational amplifier OP1 includes a positive power terminal coupled to the dimming circuit 16' to receive the control signal VCON, and a negative power terminal coupled to ground. In another embodiment, the operational amplifier OP1 can be replaced by a comparator. In the embodiment, the desired current is the setting voltage Vset1 divided by a resistance of the detecting resistor Rs1, and expressed as Vset/Rs1. Therefore, the desired current can be changed by setting a different setting voltage Vset1.

Similar to the current balance unit shown in FIG. 3A, when the regulator 221 does not work, the second transistor Q11 operates in the cut-off region. When the regulator 221 works, the second transistor Q11 operates in the linear region and the regulator 221 detects the current flowing through a corresponding light string S1 and compares it with the desired current. When the current flowing through the corresponding light string S1 is greater than the desired current (i.e. the voltage across the detecting resistor Rs1 is greater than the setting voltage Vset1), the output terminal of the operational amplifier OP1 outputs a low-level signal to control the operating point of the second transistor Q11 move to the cut-off region to reduce the current flowing through the light string S1. When the current flowing through the corresponding light string S1 is less than the desired current (i.e. the voltage across the detecting resistor Rs1 is less than the setting voltage Vset1), the output terminal of the operational amplifier OP1 outputs a high-level signal to control the operating point of the second transistor Q11 to move from the cut-off region to increase the current flowing through the light string S1.

Figure 5:
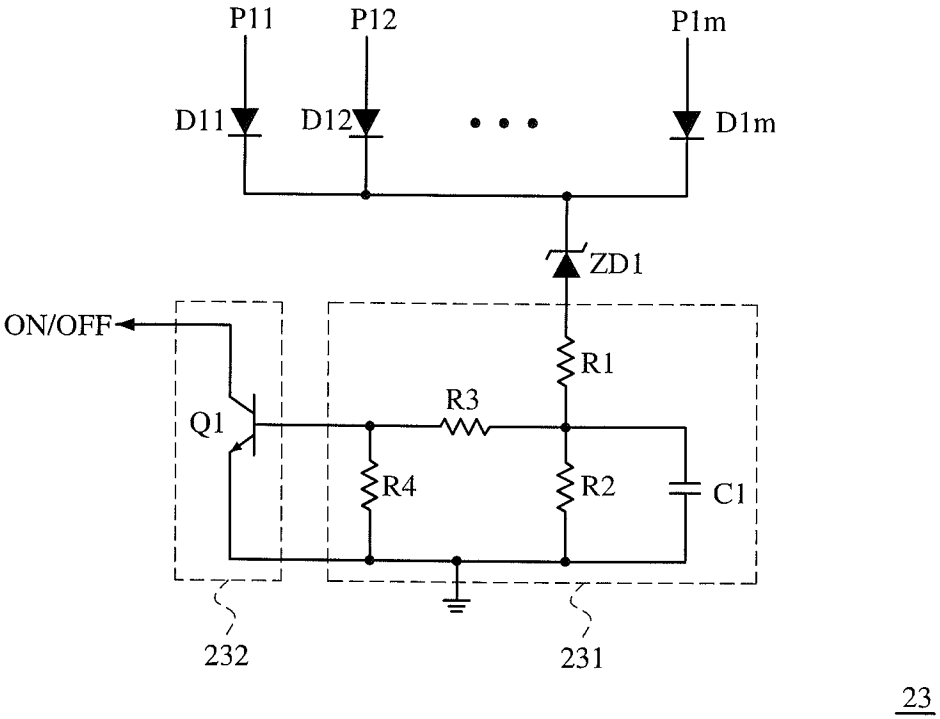
FIG. 5 is a schematic diagram illustrating an embodiment of the short-circuit protection circuit shown in FIG. 3.

FIG. 5 is a schematic diagram illustrating an embodiment of the short-circuit protection circuit 23 shown in FIG. 3. Referring to FIGS. 3 and 5, the short-circuit protection circuit 23 includes a plurality of diodes D11-Dim, a Zener diode ZD1, a voltage dividing circuit 231 and a switch circuit 232. Each diode (such as D11) includes an anode terminal coupled to the second terminal (such as P11) of a corresponding light string (such as S1) and a cathode terminal coupled to a cathode terminal of the Zener diode ZD1. An anode terminal of the Zener diode ZD1 is coupled to the voltage dividing circuit 231. The switch circuit 232 includes a first terminal coupled to the dimming circuit 16' and a second terminal coupled to a disable signal. In the embodiment, the disable signal is a low-level signal, such as a ground signal. In addition, the voltage dividing circuit 231 includes resistors R1-R4 and a capacitor C1. The resistors R1-R4 are used to divide voltage. The capacitor C1 is used to stabilize and filter voltage. The switch circuit 232 includes a first type switch Q1, and accordingly the switch circuit 232 is a first type switch circuit. The first type switch or switch circuit is turned on when its control terminal receives a high-level signal and turned off when its control terminal receives a low-level signal.

When detecting the voltage at the second terminal of one of the light strings S1-Sm is greater than the overvoltage threshold, the Zener diode ZD1 operates in a breakdown region so that a high-level signal is outputted through the voltage dividing circuit 231 to control the switch circuit 232 to be turned on, and the disable signal is transferred to the dimming circuit 16' to implement that the dimming circuit 16' receives the off signal OFF. When not detecting the voltage at the second terminal of one of the light strings S1-Sm is greater than the overvoltage threshold, the Zener diode ZD1 does not operate in the breakdown region so that a low-level signal is outputted through the voltage dividing circuit 231 to control the switch circuit 232 to be turned off, and the disable signal is not transferred to the dimming circuit 16' to implement that the dimming circuit 16' receives the on signal ON. Therefore, the overvoltage threshold can be changed by employing different Zener diodes having different breakdown voltages.

Figure 6:
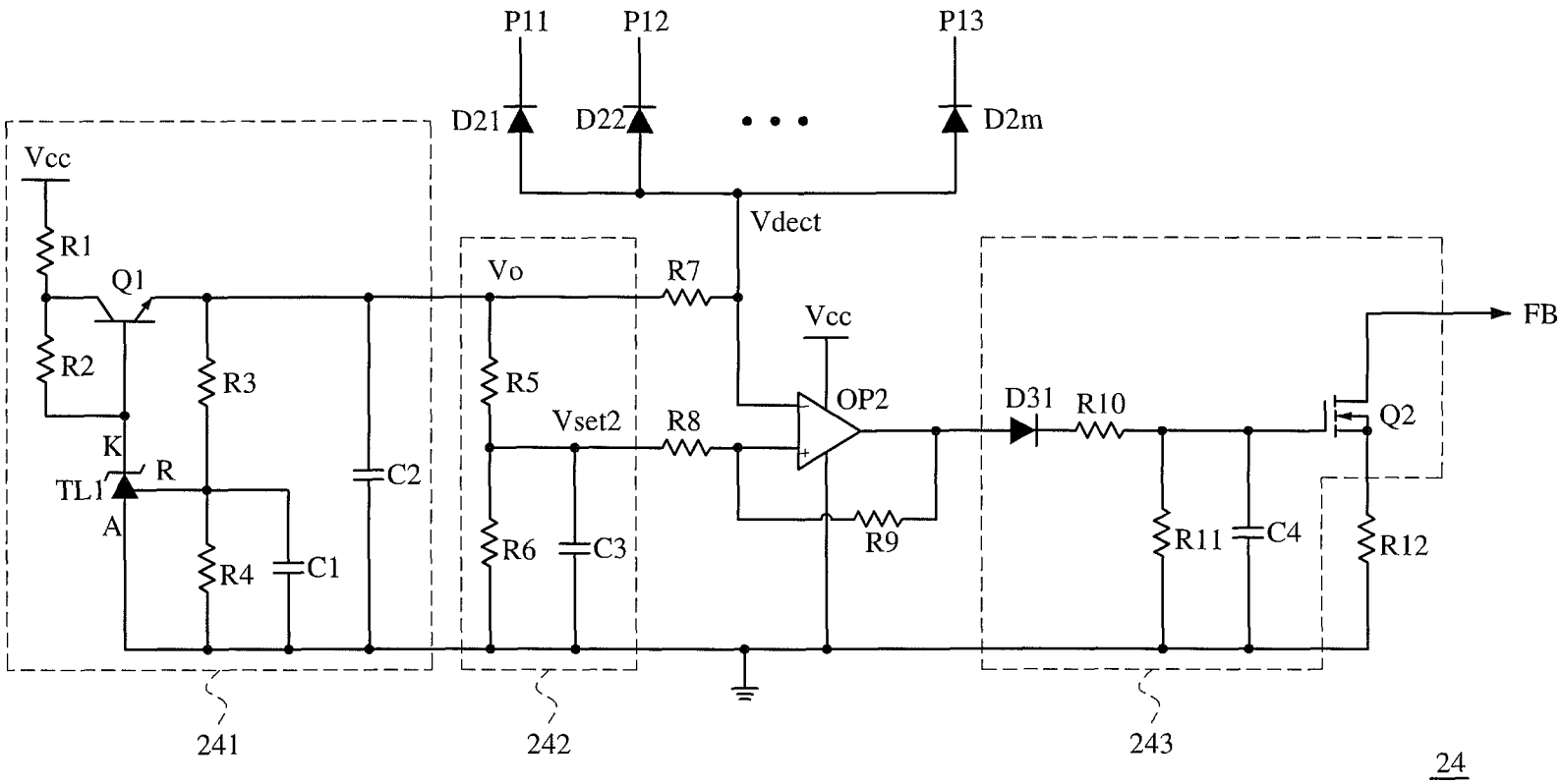
FIG. 6 is a schematic diagram illustrating an embodiment of the voltage compensation circuit shown in FIG. 3.

FIG. 6 is a schematic diagram illustrating an embodiment of the voltage compensation circuit 24 shown in FIG. 3. Referring to FIGS. 3 and 6, the voltage compensation circuit 24 includes a plurality of diodes D21-D2*m*, a constant voltage source 241, a voltage dividing circuit 242, a positive resistor R8, a negative resistor R7, an operational amplifier OP2, a switch circuit 243 and a parallel resistor R12. Each diode (such as D21) includes a cathode terminal coupled to the second terminal (such as P11) of a corresponding light string (such as S1) and an anode terminal coupled to an inverting input terminal of the operational amplifier OP2. The constant voltage source 241 provides a constant voltage Vo. The voltage dividing circuit 242 divides the constant voltage Vo to generate a setting voltage Vset2. The positive resistor R8 includes a first terminal coupled to the voltage dividing circuit 242 to receive the setting voltage Vset2 and a second terminal coupled to a non-inverting input terminal of the operational amplifier OP2. The negative resistor R7 includes a first terminal coupled to the constant voltage source 241 to receive the constant voltage Vo and a second terminal coupled to the inverting input terminal of the operational amplifier OP2. The switch circuit 243 includes a first terminal for outputting a feedback signal FB to the DC to DC converter 15, a second terminal coupled to a first terminal of the parallel resistor R12, and a control terminal coupled to an output terminal of the operational amplifier. A second terminal of the parallel resistor R12 is coupled to ground. In the embodiment, the desired voltage is the setting voltage Vset2 subtracting a voltage across the diode (such as D21).

When detecting a voltage at the second terminal of one of the light strings S1-Sm is less than a desired voltage, the operational amplifier OP2 outputs a high-level signal feedback signal FB to control the switch circuit 243 (or the first type switch Q2) to be turned on to control the DC to DC converter 15 to increase the second DC voltage Vdc2. When not detecting the voltage at the second terminal of one of the light strings S1-Sm is less than the desired voltage, the operational amplifier OP2 outputs a low-level signal feedback signal FB to control the switch circuit 243 (or the first type switch Q2) to be turned off to control the DC to DC converter 15 to decrease the second DC voltage Vdc2.

Figure 7:
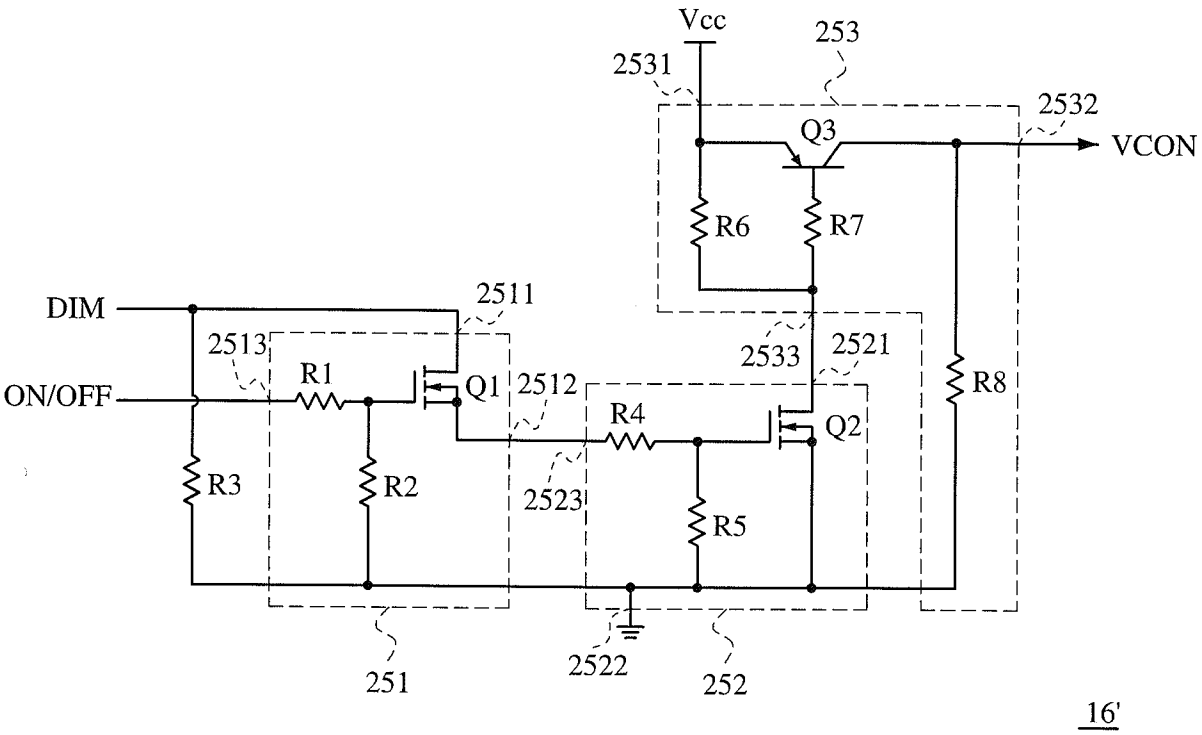
FIG. 7 is a schematic diagram illustrating an embodiment of the dimming circuit shown in FIG. 3.

FIG. 7 is a schematic diagram illustrating an embodiment of the dimming circuit 16' shown in FIG. 3. Referring to FIGS. 3 and 7, the dimming circuit 16' includes a first switch circuit 251, a second switch circuit 252 and a third switch circuit 253. A first terminal 2511 of the first switch circuit 251 receives the dimming signal DIM. A second terminal 2512 of the first switch circuit 251 is coupled to a control terminal 2523 of the second switch circuit 252. A control terminal 2513 of the first switch circuit 251 is coupled to the short-circuit protection circuit 23 to receive the off signal OFF or the on signal ON. A first terminal 2521 of the second switch circuit 252 is coupled to a control terminal 2533 of the third switch circuit 253. The second terminal 2522 of the second switch circuit 252 is coupled to a low-level signal, and the first terminal 2531 of the third switch circuit 253 is coupled to a high-level signal. The second terminal 2532 of the third switch circuit 253 outputs the control signal VCON. The second switch circuit 252 and the third switch circuit 253 are turned off when their control terminals do not receive a signal, and the control signal VCON is a low-level signal when the third switch circuit 253 is turned off. The first switch circuit 251 includes a first type switch Q1 to be a first type switch circuit, the second switch circuit 252 includes a first type switch Q2 to be a first type switch circuit, and the third switch circuit 253 includes a second type switch Q3 to be a second type switch circuit. The second type switch or switch circuit is turned on when its control terminal receives a low-level signal and turned off when its control terminal receives a high-level signal.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

We claim:

1. A serial-type LED device comprising:

a DC to DC converter receiving a first DC voltage and converting the first DC voltage to a second DC voltage according to a feedback signal;

p light source units each comprising a first terminal, a second terminal, m light strings and m current balance units, with each light string comprising a plurality of LEDs coupled in series to have a first terminal coupled to the first terminal of a corresponding light source unit and a second terminal coupled to the second terminal of the corresponding light source unit through a corresponding current balance unit, wherein the p light source units are first to p-th light source units, wherein the first terminal of the first light source unit is coupled to the DC to DC converter to receive the second DC voltage, and wherein the second terminal of the i-th light source unit is coupled to the first terminal of the (i+1)-th light source unit, where m and p are integers greater than or equal to 2, and i is any integer from 1 to (p−1); and a dimming circuit coupled to the second terminal of the p-th light source unit, with the dimming circuit outputting a control signal to control the current balance units of the p-th light source unit not to work when receiving an off signal, and outputting the control signal to control the current balance units of the p-th light source unit to alternatively work and not work according to a dimming signal when receiving an on signal;

wherein:

each current balance unit of the q-th light source unit comprises a first transistor, where q is any integer from 1 to (p−1), wherein each first transistor comprises a first terminal coupled to the second terminal of a corresponding light string, a second terminal coupled to the second terminal of the q-th light source unit, and a control terminal, wherein the control terminals of the first transistors are coupled to each other and to the first terminal of one of the first transistors, wherein the first transistors of the q-th light source unit constitute a q-th current mirror;

each current balance unit of the p-th light source unit comprises a second transistor and a regulator, wherein each second transistor comprises a first terminal coupled to the second terminal of a corresponding light string, a second terminal coupled to ground through a corresponding regulator, and a control terminal, wherein when the regulator does not work, each second transistor operates in a cut-off region, and when the regulator works, each second transistor operates in a linear region and the regulator detects a current flowing through the corresponding light string and compares the current flowing through the corresponding light string with a desired current to control the operating point of each second transistor to move to the cut-off region when the current flowing through the corresponding light string is greater than the desired current, and to control the operating point of each second transistor to move from the cut-off region when the current flowing through the corresponding light string is less than the desired current; and each regulator comprises an operational amplifier and a detecting resistor, wherein the operational amplifier comprises a non-inverting input terminal coupled to a setting voltage, an inverting input terminal coupled to the second terminal of the second transistor, an output terminal coupled to the control terminal of the second transistor, and a power terminal coupled to the dimming circuit to receive the control signal, wherein the detecting resistor comprises a first terminal coupled to the second terminal of the second transistor, and a second terminal coupled to ground, wherein the desired current is the setting voltage divided by a resistance of the detecting resistor.

2. The serial-type LED device according to claim 1, wherein the dimming circuit comprises a first switch circuit, a second switch circuit and a third switch circuit, wherein a first terminal of the first switch circuit receives the dimming signal, wherein a second terminal of the first switch circuit is coupled to a control terminal of the second switch circuit, wherein a control terminal of the first switch circuit is coupled to the short-circuit protection circuit to receive the off signal or the on signal, wherein a first terminal of the second switch circuit is coupled to a control terminal of the third switch circuit, wherein a second terminal of the second switch circuit is coupled to a low-level signal, wherein a first terminal of the third switch circuit is coupled to a high-level signal, wherein a second terminal of the third switch circuit outputs the control signal, wherein the second switch circuit and the third switch circuit are turned off when their control terminals do not receive a signal, and wherein the control signal is a low-level signal when the third switch circuit is turned off.

3. The serial-type LED device according to claim 1, wherein the p-th light source unit further comprises:

a short-circuit protection circuit outputting the off signal when detecting a voltage at the second terminal of one of the light strings is greater than an overvoltage threshold, and outputting the on signal when not detecting the voltage at the second terminal of one of the light strings is greater than the overvoltage threshold; and a voltage compensation circuit for outputting the feedback signal to control the DC to DC converter to increase the second DC voltage when detecting a voltage at the second terminal of one of the light strings is less than a desired voltage, and not working when not detecting the voltage at the second terminal of one of the light strings is less than the desired voltage.

4. The serial-type LED device according to claim 3, wherein the voltage compensation circuit comprises a plurality of diodes, a constant voltage source, a voltage dividing circuit, a positive resistor, a negative resistor, an operational amplifier, a switch circuit and a parallel resistor, wherein each diode comprising a cathode terminal coupled to the second terminal of a corresponding light string and an anode terminal coupled to an inverting input terminal of the operational amplifier, wherein the constant voltage source provides a constant voltage, wherein the voltage dividing circuit divides the constant voltage to generate a setting voltage, wherein the positive resistor comprises a first terminal coupled to the voltage dividing circuit to receive the setting voltage and a second terminal coupled to a non-inverting input terminal of the operational amplifier, wherein the negative resistor comprises a first terminal coupled to the constant voltage source to receive the constant voltage and a second terminal coupled to the inverting input terminal of the operational amplifier, wherein the switch circuit comprises a first terminal for outputting the feedback signal to the DC to DC converter, a second terminal coupled to a first terminal of the parallel resistor, and a control terminal coupled to an output terminal of the operational amplifier, wherein a second terminal of the parallel resistor is coupled to ground, and wherein the desired voltage is the setting voltage subtracting a voltage across the diode.

5. The serial-type LED device according to claim 4, wherein the voltage compensation circuit further comprises a feedback resistor, wherein first and second terminals of the feedback resistor are coupled to the non-inverting input terminal and the output terminal of the operational amplifier, respectively.

6. A serial-type LED device comprising:

a DC to DC converter receiving a first DC voltage and converting the first DC voltage to a second DC voltage according to a feedback signal;

p light source units each comprising a first terminal, a second terminal, m light strings and m current balance units, with each light string comprising a plurality of LEDs coupled in series to have a first terminal coupled to the first terminal of a corresponding light source unit and a second terminal coupled to the second terminal of the corresponding light source unit through a corresponding current balance unit, wherein the p light source units are first to p-th light source units, wherein the first terminal of the first light source unit is coupled to the DC to DC converter to receive the second DC voltage, and wherein the second terminal of the i-th light source unit is coupled to the first terminal of the (i+1)-th light source unit, where m and p are integers greater than or equal to 2, and i is any integer from 1 to (p−1); and a dimming circuit coupled to the second terminal of the p-th light source unit, with the dimming circuit outputting a control signal to control the current balance units of the p-th light source unit not to work when receiving an off signal, and outputting the control signal to control the current balance units of the p-th light source unit to alternatively work and not work according to a dimming signal when receiving an on signal;

wherein:

each current balance unit of the q-th light source unit comprises a first transistor, where q is any integer from 1 to (p−1), wherein each first transistor comprises a first terminal coupled to the second terminal of a corresponding light string, a second terminal coupled to the second terminal of the q-th light source unit, and a control terminal, wherein the control terminals of the first transistors are coupled to each other and to the first terminal of one of the first transistors, wherein the first transistors of the q-th light source unit constitute a q-th current mirror;

each current balance unit of the p-th light source unit comprises a second transistor and a regulator, wherein each second transistor comprises a first terminal coupled to the second terminal of a corresponding light string, a second terminal coupled to ground through a corresponding regulator, and a control terminal, wherein when the regulator does not work, each second transistor operates in a cut-off region, and when the regulator works, each second transistor operates in a linear region and the regulator detects a current flowing through the corresponding light string and compares the current flowing through the corresponding light string with a desired current to control the operating point of each second transistor to move to the cut-off region when the current flowing through the corresponding light string is greater than the desired current, and to control the operating point of each second transistor to move from the cut-off region when the current flowing through the corresponding light string is less than the desired current; and the p-th light source unit further comprises:

a short-circuit protection circuit outputting the off signal when detecting a voltage at the second terminal of one of the light strings is greater than an overvoltage threshold, and outputting the on signal when not detecting the voltage at the second terminal of one of the light strings is greater than the overvoltage threshold; and a voltage compensation circuit for outputting the feedback signal to control the DC to DC converter to increase the second DC voltage when detecting a voltage at the second terminal of one of the light strings is less than a desired voltage, and not working when not detecting the voltage at the second terminal of one of the light strings is less than the desired voltage, wherein the short-circuit protection circuit comprises a plurality of diodes, a Zener diode, a voltage dividing circuit and a switch circuit, wherein each diode comprises an anode terminal coupled to the second terminal of a corresponding light string and a cathode terminal coupled to a cathode terminal of the Zener diode, wherein an anode terminal of the Zener diode is coupled to the voltage dividing circuit, wherein the switch circuit comprises a first terminal coupled to the dimming circuit and a second terminal coupled to a disable signal, wherein when detecting the voltage at the second terminal of one of the light strings is greater than the overvoltage threshold, the Zener diode operates in a breakdown region with a high-level signal outputted through the voltage dividing circuit to control the switch circuit to be turned on, wherein the disable signal is transferred to the dimming circuit to implement that the dimming circuit receives the off signal, and wherein when not detecting the voltage at the second terminal of one of the light strings is greater than the overvoltage threshold, the Zener diode does not operate in the breakdown region with a low-level signal outputted through the voltage dividing circuit to control the switch circuit to be turned off, wherein the disable signal is not transferred to the dimming circuit to implement that the dimming circuit receives the on signal.

* * * * *